United States Patent [19]

Tsubusaki et al.

[11] 4,359,238

[45] Nov. 16, 1982

[54] IMAGE-RECEIVING SHEET

[75] Inventors: Shigeru Tsubusaki, Hirakata; Yuji Takashima, Nishinomiya, both of Japan

[73] Assignee: Matsushita Electric Industrial Co., Ltd., Japan

[21] Appl. No.: 189,941

[22] Filed: Sep. 22, 1980

[30] Foreign Application Priority Data

Sep. 21, 1979 [JP] Japan ..... 54-122319

[51] Int. Cl.[3] ..... B41M 5/22

[52] U.S. Cl. ..... 282/27.5; 346/135.1; 427/121; 428/206; 428/207; 428/330; 428/331; 428/537; 428/689

[58] Field of Search ..... 282/27.5; 346/135.1, 346/153, 157; 369/1; 427/121, 150, 151; 428/323, 327, 331, 537, 409, 330, 689, 206–208, 211, 212

[56] References Cited

FOREIGN PATENT DOCUMENTS 54-80137 6/1979 Japan ..... 282/27.5

1527168 10/1978 United Kingdom ..... 282/27.5

*Primary Examiner*—Bruce H. Hess

*Attorney, Agent, or Firm*—Wenderoth, Lind & Ponack

[57] ABSTRACT

An image-receiving sheet for receiving a particle image electrostatically formed on a photoconductive surface and for fixing thereon a dye-image obtained by developing a sublimable dye former contained in the image particles. The sheet comprises a support member, color developing layer disposed on the support member and a dielectric layer disposed on the color developing layer. The color forming layer contains a developer material for developing the sublimable dye former. The dielectric layer exhibits in a low humidity range, a surface resistivity high enough to electrostatically retain the particle on the surface thereof and also exhibits adhesion high enough to adhesively retain the particles in high humidity range where the surface resistivity is below the required value for retaining the particles.

11 Claims, 1 Drawing Figure

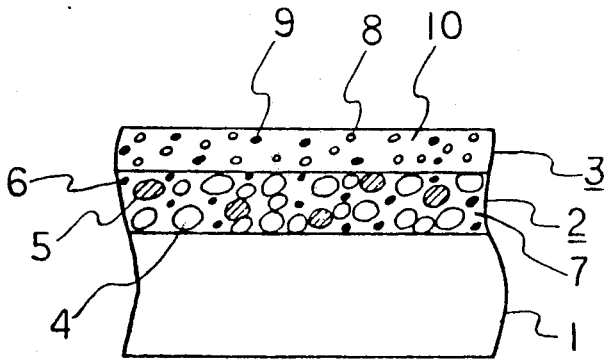
9
8
10
6
3
5
2
7
4
1

IMAGE-RECEIVING SHEET

BACKGROUND OF THE INVENTION

This invention relates to electrostatic recording and more particularly relates to an image-receiving sheet adapted to receive on the surface thereof a particle image electrostatically formed on a photoconductive surface and whereon a final colored-image is fixed.

The image-receiving sheet of this invention is used for the electrostatic recording process, for example, such as disclosed in British Pat. No. 1,527,168. In that process there is provided an image composing particle containing a colorless sublimable dye. The image-receiving sheet contains a developer which reacts with the colorless sublimable dye to develop a color. The image composed of particles is formed on a photoconductive insulating surface by a suitable electrostatic method and then are transferred to the image-receiving sheet. The particles are then heated, whereby the colorless sublimable dye-former present in the particle is sublimed and reacted with the developer present in the image-receiving sheet to develop a color. The remaining parts of the image composing particles are then removed from the surface of the image-receiving sheet. Thus the fixed dye-image is obtained on the image-receiving sheet.

In such process, the following method of forming the particle image is especially useful. The photoconductive surface is charged and the image composing particles are laid uniformly thereon. The image composing particle is transmissive to a light of selected color, i.e., functions as a color filter, further to containing a sublimable dye as above mentioned. The photoconductive surface is exposed to imagewise light through the image composing particles, thereby forming an electrostatic image corresponding to an image of selected color of light. Then the image composing particles in the area where the electrostatic attractive force is weakened in accordance with the electrostatic image are removed, whereby the particle image is obtained. By utilizing such process, a multicolored dye image can be formed through only one exposure as described in British Pat. No. 1,527,168.

As a matter of course the particle image formation according to the usual xerography may be used.

As an image-receiving sheet applicable to the above-mentioned process, there has been proposed a structure such that a color forming layer containing a developer material is disposed on a support member such as paper and on the color forming layer is disposed a dielectric surface layer which serves to electrostatically retain the transferred image-composing-particles. The dielectric layer necessarily has a structure such that the sublimed dye gas can pass therethrough to the color forming layer. Therefore the surface resistivity of the dielectric layer decreases due to moisture absorption under a high humidity atmosphere such as a relative humidity of more than 60%. Thus the electrostatic charge on the dielectric layer is decreased under high humidity, resulting in low efficiency of transfer of the image composing particles from the photoconductive surface to the image-receiving sheet.

SUMMARY OF THE INVENTION

It is an object of the invention to provide an image-receiving sheet which can efficiently retain image composing particles transferred from a photoconductive surface over the practical range of humidity in the atmosphere.

An image-receiving sheet according to this invention comprises a supporting member, a color developing layer disposed on the supporting member and containing a developer material which reacts with a sublimable dye-former to develop a color, and a dielectric layer coated on the color developing layer, the dielectric layer exhibiting high surface resistivity in low humidity range in an atmosphere and exhibiting high adhesion in the high humidity range where the surface resistivity thereof is lower than the required value.

BRIEF DESCRIPTION OF THE DRAWING

FIGURE is a sectional view of an image-receiving sheet according to the invention.

DETAILED DESCRIPTION OF THE INVENTION

Referring to the FIGURE, a supporting paper 1 is coated with a color developing layer 2, and a dielectric layer 3 is formed on the color developing layer 2. THe color developing layer 2 contains, as a principal component, an activated clay 4 which acts as a developer for a sublimable dye-former. The color developing layer 2 also contains fine inorganic powders 5 and 6 having a white color. The activated clay 4 and the inorganic powders 5 and 6 are dispersed into plastic binder 7. The surface resistivity of the color forming layer 2 is less than $10^9\Omega$ and so the layer 2 can act as an electrode for preventing image composing particles from being scattered applied voltage during an electrostatic transfer of the particles. Thus it be desirable that the activated clay 4 is of low particle resistivity.

The inorganic powder 4 serves to prevent yellowing of the color forming layer 2 due to heating and may be a calcium carbonate. The inorganic powder 6 serves as a developing assistant agent and may be a silica. These inorganic powders are also effective for improving heat resistance. The binder 7 should have high binding power and hardly be yellowed by heating. For example, styrene-butadiene copolymer, acrylic resin or polyvinyl acetate may be used. Especially water-based emulsions of those resins are preferable because they do not so much conceal the activated clay, which is favorable for obtaining high density color development.

The appropriate ratio of those components is that the amount of the inorganic powders 5 and 6 is 20 80 parts by weight and the binder 7, 10 to 30 parts by weight to 100 parts by weight of the activated clay 4. A dispersant such as a surface-active agent, etc. may be used.

The coating amount of the color developing layer 2 is preferably 5 to 10 g/m$^2$ for obtaining low surface resistance and sufficient density of color development. The color developing layer is preferably subjected to calendering for making the surface resistance uniform.

The supporting paper 1 is preferably a fine quality paper having smooth surface which does not repel coating, whereby a uniform surface of coated layer is obtained.

The dielectric layer 3 is composed of a release agent 8, a fine inorganic powder 9 and a binder 10. The release agent 8 makes it easy to release the image composing particles from the surface of the dielectric layer 3 after the heating for developing color. The inorganic powder 9 has a white color and permits the dye-former gas sublimed from the image composing particles to pass through the dielectric layer 3 to the color developing layer 2.

The release agent 8 may be fine particles of a transparent or white polyethylene. It is prepared in water-based emulsion state. The inorganic powder 9 may be a silica which is effective for assisting the development, and is preferably prepared by wet process, i.e., a colloidal silica, because it has high activity. The binder 10 should have the properties of high resistivity, strong binding power to the color developing layer and large bending strength. Further the binder 10 should exhibit, under a high humidity atmosphere such as a relative humidity of more than 60%, adhesion sufficient to retain the image composing particles through the influence of moisture. It also should have the property that sublimed dye-former gas can easily pass therethrough. Styrene-butadiene copolymer may be used as the binder 10 and it is prepared in the form of a water-based emulsion.

The amount of silica used in the dielectric layer 3 should be in the range of from 25 to 70 parts by weight to 100 parts by weight of the total amount of the release agent 8 of polystyrene and the binder 10 of styrene-butadiene copolymer. Below that range, the dielectric layer 3 has so low a heat resistance that it is difficult to remove the image composing particles after the heat development, because of the softening of the layer 3. At above that range the dielectric layer 3 has low resistivity and low adhesion under low humidity so as not to be able to sufficiently retain the image composing particles. The amount of styrene-butadiene copolymer should be in the range from 0.3 to 1 parts by weight to 1 part by weight of polystyrene. At below that range the binding power becomes insufficient and at above that range the adhesion under high humidity becomes so high that it is difficult to remove the image composing particles after heating for color development.

A dispersant such as a surface-active agent or a thickening agent may be used when those components are dispersed and mixed. The coating thickness of the dielectric layer 3 is preferably 2 to 5 g/m$^2$. In such range the path from the image composing particle to the color developing layer 2 through which sublimed dye-formed gas passes is short enough to obtain desirable density of developed color, and besides a sufficient efficiency particles is obtained.

The particle diameters of polystyrene and styrene-butadiene copolymer is preferably from 0.1 to 0.5$\mu$ and that of silica is preferably from 0.1 to 0.001$\mu$.

The thus obtained dielectric layer 3 exhibits a surface resistivity more than $10^{10}\Omega$ under the atmosphere of relative humidity below 60% so as to be able to electrostatically retain the image composing particles. It also exhibits, under a relative humidity above 60%, an adhesion sufficient to retain the image composing particles. The relative humidity at above which the sufficient adhesion is obtained changes in proportion to the ratio of the components. In above description, sufficient adhesion means the such extent to which particles are retained under a linear pressure of 100 to 1000 g/cm, the efficiency of transferring particles with the diameter of 5 to 50$\mu$ being more than 80%, and the retained particles being removed by using fur brush after heat development for 1.5 seconds at 230° C.

A more detailed example is described hereinafter.

According to the following formulation, coatings for forming a color developing layer and a dielectric layer were prepared. In the following formulation the amount of each component is shown by the amount of solid content.

| | |
|---|---|
| Coating for a color forming layer: | |
| Activated clay: | 100 parts by weight |
| Calcium carbonate: | 30 parts by weight |
| Colloidal silica (in which the: ratio of solid content is 20%) | 20 parts by weight |
| Styrene-Butadiene copolymer: (in which the ratio of solid content is 50%) | 15 parts by weight |
| Water | 435 parts by weight |
| Coating for a dielectric layer: | |
| Water dispersion of low molecular: weight polyethylene (in which the ratio of solid content is 20%) | 100 parts by weight |
| Colloidal silica (in which the ratio: of solid content is 20%). | 60 parts by weight |
| Styrene-butadiene copolymer (in: which the ratio of solid content is 50%) | 50 parts by weight |

The coating for a color developing layer was prepared by dispersing the components for 30 minutes with an attritor. Calcium carbonate is used after dispersing, with water mixed, for 1 hour with an attritor. The coating for a dielectric layer was prepared by mixing the component with stirrer.

The coating for a color developing layer was coated on a fine quality paper at 8 g/m$^2$ which represents the value after drying, and then the coated layer was subjected to calendering. The thus formed color forming layer was coated with the coating for a dielectric layer at 3 g/m$^2$ which represents the value after drying, and then calendering was carried out.

The obtained image-receiving sheet was measured for the surface resistivity and the particle transfer efficiency under various humidities in a constant temperature bath. The temperature of the bath was maintained at 30° C. and the humidity was varied. The measurement was performed after keeping the image receiving sheet in the constant temperature bath for 1 hour. The particle transfer efficiency was measured by performing a transfer process such that the dielectric layer surface of the image receiving sheet was closely contacted with the image composing particles which are electrostatically retained a photoconductive plate composed by coating a zinc oxide photoconductive layer on an aluminum plate, and a voltage of 1.0 KV was supplied between the conductive layer of the photoconductive plate and the back surface of the image-receiving sheet, with the image-receiving sheet being pressed to the particles. The result of the measurement is shown in the following Table.

TABLE

| Relative humidity (%) | Surface resistivity (Ω) | Transfer efficiency (%) |
|---|---|---|
| 24 | $2.9 \times 10^{13}$ | 90 |
| 50 | $4.0 \times 10^{12}$ | 90 |
| 60 | $9.2 \times 10^{10}$ | 85 |
| 80 | $8.2 \times 10^{8}$ | 85 to 80 |
| 93 | $4.6 \times 10^{8}$ | 80 |

In the measurement where the humidities of 80% and 93%, were employed the particle transfer was performed by only applying pressure.

The image composing particles was scarcely scattered by the transfer. The transfer properties were similar in both cases of using a nonconductive image-composing-particle and a conductive particle.

In order to examine a developed dye image, the image composing particles transferred to the image-receiving sheet were pressed by a hot plate with the temperature of 230° C. for 1.5 seconds, and then the remainder of the particles were removed. The thus obtained dye image had fully developed color and was clear; without fogging.

Further, the image composing particles could be completely removed even in the case where the above-mentioned process was performed under the relative humidity of 80% or 93%.

What is claimed is:

1. An image-receiving sheet for receiving an electrostatically formed image, said image comprising particles containing a sublimable dye-former on which is fixed a colored image obtained by making said sublimable dye-former react with a developer contained in the sheet, said sheet comprising:

a support member;

a color developing layer formed on said support member and containing a developer material which reacts with a sublimable dye-former to develop a color, the surface resistivity thereof being less than $10^9\Omega$; and a dielectric layer formed on said color developing layer through which sublimed dye-former gas can pass to said color developing layer, said dielectric layer comprising a fine inorganic powder and a transparent binder-resin having high resistivity.

2. An image-receiving sheet as claimed in claim 1, wherein said dielectric layer further comprises a release agent for making it easy to release said image composing particles adhered to the dielectric layer therefrom.

3. An image-receiving sheet as claimed in claim 2, wherein said release agent comprises a fine polyethylene powder.

4. An image-receiving sheet as claimed in claim 2, wherein said release agent is a fine polyethylene powder, said inorganic powder is silica and said binder is a styrene-butadiene copolymer, the ratio of said components being such that the amount of said silica is 25 to 70 parts by weight to 100 parts by weight of the total amount of said polyethylene and styrene-butadiene copolymer.

5. An image-receiving sheet as claimed in claim 4, wherein the amount of said styrene-butadiene copolymer is 0.3 to 1 parts by weight to 1 part by weight of said polyethylene.

6. An image-receiving sheet as claimed in claim 1, wherein said inorganic powder is effective as an assistant for developing said sublimable dye-former.

7. An image-receiving sheet as claimed in claim 1, wherein said inorganic powder comprises a silica.

8. An image-receiving sheet as claimed in claim 1, wherein said binder comprises a styrene-butadiene copolymer.

9. An image-receiving sheet as claimed in claim 1, wherein said color developing layer comprises said developer material, a fine inorganic powder and a binder.

10. An image-receiving sheet as claimed in claim 1, wherein said developer material comprises an activated clay.

11. An image-receiving sheet as claimed in claim 10, wherein said inorganic powder comprises a calcium carbonate and a silica.

* * * * *